US006815910B2

(12) United States Patent
Suzuki et al.

(10) Patent No.: US 6,815,910 B2
(45) Date of Patent: Nov. 9, 2004

(54) DEVICE FOR OPERATING A HIGH PRESSURE DISCHARGE LAMP

(75) Inventors: Yoshikazu Suzuki, Kanagawa (JP); Tomoyoshi Arimoto, Hyogo (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/602,917

(22) Filed: Jun. 25, 2003

(65) Prior Publication Data

US 2004/0004449 A1 Jan. 8, 2004

(30) Foreign Application Priority Data

Jul. 2, 2002 (JP) ..... 2002-193501

(51) Int. Cl.[7] ..... H05B 37/02; H05B 37/00
(52) U.S. Cl. ..... 315/291; 315/209 R; 315/244
(58) Field of Search ..... 315/291, 209 R, 315/217, 218, 308, 244, 226, DIG. 5, DIG. 7

(56) References Cited

U.S. PATENT DOCUMENTS 4,734,624 A * 3/1988 Nagase et al. ..... 315/243
4,749,914 A * 6/1988 Feher et al. ..... 315/246
4,912,374 A * 3/1990 Nagase et al. ..... 315/244
5,434,474 A * 7/1995 Ukita et al. ..... 315/128
5,514,935 A 5/1996 Oda et al.
5,565,743 A 10/1996 Yamashita et al.
5,680,015 A * 10/1997 Bernitz et al. ..... 315/291
5,844,379 A * 12/1998 Stommen et al. ..... 315/273
6,426,597 B2 * 7/2002 Rast et al. ..... 315/219

OTHER PUBLICATIONS

European Search Report Dated Sep. 29, 2003.

* cited by examiner

*Primary Examiner*—Don Wong
*Assistant Examiner*—Chuc Tran
(74) *Attorney, Agent, or Firm*—Nixon Peabody LLP; David S. Safran

(57) ABSTRACT

To prevent lamp extinction during dead time of an inverter circuit of a full bridge system, to reduce delays of the rising time and the falling time of rectangular waves which have been output by the inverter circuit and to prevent formation of a phenomenon of momentary darkening of the radiant light, the discharge lamp is operated with an alternating current with rectangular waves which is produced by an inverter circuit of a full bridge system. When the inverter circuit of the full bridge system is driven a dead time is taken in which all switching devices are turned off. In the rear stage of the inverter circuit of the full bridge system, there is an inductance. The value of the inductance is fixed such that LL≧VL/IL·Td (VL being the luminous voltage of the discharge lamp, IL being the current and Td the dead time). Current can flow in the discharge lamp during the dead time by the energy stored in this inductance.

2 Claims, 5 Drawing Sheets

DEVICE FOR OPERATING A HIGH PRESSURE DISCHARGE LAMP

BACKGROUND OF THE INVENTION

1. Field of the Invention

The invention relates to a device for operating a high pressure discharge lamp which is used for a liquid crystal projector and the like.

2. Description of Related Art

Ordinarily, a circuit as shown, for example, in FIG. 5, is known as a lighting circuit for operating a high pressure discharge lamp with rectangular waves using an electronic circuit. In the circuit shown in FIG. 5, a lighting circuit is formed from a full bridge circuit 2 which is formed of a switching device Q1, a DC source, switching devices Q2 to Q5, diodes D2 to D5, and an ignition coil 4.

The lighting circuit shown in FIG. 5 alternately turns on the switching devices Q2, Q5 and the switching devices Q3, Q4 of the full bridge circuit 2 by supplying a voltage and a current from the direct current source to the full bridge system 2. Thus, a high pressure discharge lamp 3 is supplied with an AC voltage with rectangular waves and is operated in this way. When the high pressure discharge lamp is started, the ignition coil 4 applies a high voltage pulse to the lamp 3, by which the lamp is started.

In the device for operating a lamp with the above described arrangement, normally, a time is taken which is called the dead time Td and in which the switching devices Q2 to Q5 of the full bridge circuit 2 are all switched off in order to prevent a cross current of the full bridge circuit 2 and to prevent damage of the switching devices Q2 to Q5 and the switching device Q1 for controlling the wattage 2.

There is also a case in which, without the dead time Td, with a reactance coil L1 which is located on the rear stage of the switching device Q1 for controlling the wattage, the cross current of the bridge circuit is limited to less than or equal to a certain value and by which damage to the components is prevented. However, here, the disadvantages of an increase in the damage to components, formation of noise and similar disadvantages often arise. Therefore, normally, the dead time is chosen in general.

However, if rectangular waves with a low frequency with a dead time are applied to the high pressure discharge lamp, there are cases in which there are the disadvantages that the current which flows in the high pressure discharge lamp is interrupted, the lamp goes out and a re-ignition spike or the like occurs.

To prevent current interruption by the dead time Td, for example, the measure which is described in Japanese patent disclosure document HEI 6-101388 (U.S. Pat. No. 4,734,624) is known. In this publication, an inductance is connected in series to the lamp, there is a capacitor parallel to this series connection, and thus, a LC-resonant circuit is formed. During the dead time, a series resonance is formed with the rectangular waves by the above described inductance and the above described capacitor, and an oscillating current is allowed to flow in the lamp. For this reason, the attempt is made to eliminate the time during which current does not flow.

However, in the process described in the aforementioned publication, a large capacitor, for example, in which C3=0.1 $\mu$F, is connected on the rear stage of a full bridge circuit. Therefore, it is difficult to obtain a steep output of the rectangular waves of the switching devices Q2 to Q5 of the full bridge circuit 2, resulting in the undesirable phenomenon that the radiant light from the high pressure discharge lamp instantaneously darkens for a moment. This reduction of the brightness in an application as a light source of a projector device of the projection type is a serious disadvantage. Furthermore, a large L2 of 1 mH must be used, by which a reduction in the size and weight of the luminous current source is difficult.

When C3 and L2 have the above described values, the oscillating current which flows in the high pressure discharge lamp has a frequency of 16 kHz and a period of roughly 63 $\mu$s. In this way, a change of the waveform, overshoot and undershoot occur more often.

SUMMARY OF THE INVENTION

The invention was devised to eliminate the above described disadvantages in the prior art. A primary object of the present invention is to prevent lamp extinction during the dead time in a device for operating a high pressure discharge lamp using an inverter circuit of a full bridge system in which a dead time is taken, and in which, furthermore, switching devices are driven to prevent lamp extinction during the dead time, to reduce the delays of the rising time and the falling time of the rectangular waves which have been output by the inverter circuit by the effects of the inductance L, of the capacitor C and the like, and to prevent formation of the phenomenon of instantaneous darkening of the radiant light.

The object is achieved as in accordance with the invention as follows:

(1) In a device for operating a high pressure discharge lamp with a feed device with an inverter circuit in which four switching devices are connected in a bridge-like manner, in which a dead time is taken in which all switching devices are turned off, and which thus feeds the high pressure discharge lamp with an alternating current, on the forward stage of the inverter circuit there is a capacitor for forming a loop which in the above described dead time supplies a current to the high pressure discharge lamp and moreover on the rear stage of the inverter circuit there is an inductance element which is connected to the high pressure discharge lamp in series and which together with the above described capacitor forms the above described loop. The value LL of the inductance L of the above described inductance element is fixed at a value that is greater than or equal to the value at which a current can be supplied without interruption to the high pressure discharge lamp during the above described dead time by the energy stored in this inductance. This means that the value LL of the above described inductance L is established such that $LL \geqq VL/IL \cdot Td$ where VL is the luminous voltage of the discharge lamp, IL is the current flowing in the discharge lamp and Td is the dead time in Td (seconds).

(2) In (1), at least part of the inductance element is formed from an ignition coil transformer.

By the above described arrangement in accordance with the invention, even during the dead time, in the high pressure discharge lamp, a current can be allowed to flow by the energy which has been stored in the above described inductance element, and thus, lamp extinction which is produced by the dead time of the alternating rectangular waves can be prevented. Furthermore, the rising and falling of the alternating rectangular waves can be made steep because the value LL of the above described inductance element need not be large. Thus, the disadvantage of an instantaneous darkening of the high pressure discharge lamp can be eliminated and furthermore a reduction in the size and weight of the lighting current source can be achieved.

The invention is described below using several embodiments shown in the drawings.

BRIEF DESCRIPTIONS OF THE INVENTION

DETAILED DESCRIPTION OF THE INVENTION

Figure 1:
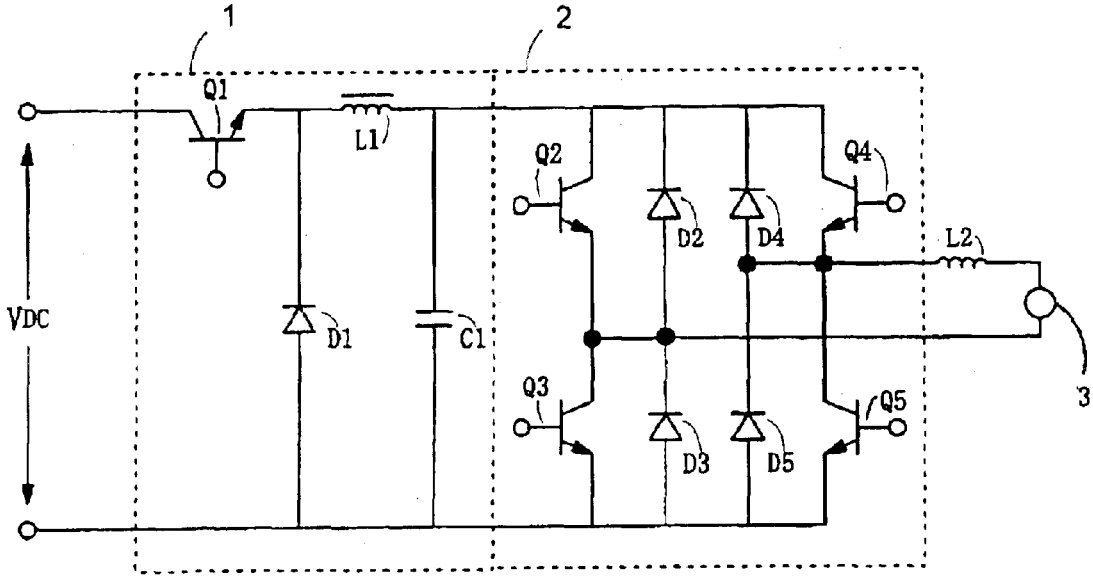
FIG. 1 shows a schematic of the first embodiment of the arrangement of a device in accordance with the invention for operating a high pressure discharge lamp.

FIG. 1 shows the first embodiment of the arrangement of a device in accordance with the invention for operating a high pressure discharge lamp in which a DC voltage is supplied to a voltage reduction chopper circuit 1, and a high pressure discharge lamp 3 (hereinafter called a discharge lamp 3) is connected to the output side of the voltage reduction chopper circuit 1 via an invertor circuit of a full bridge system 2 (hereinafter called a full bridge circuit 2) which converts the DC voltage into an AC voltage with rectangular waves and supplies it to an inductance L2 which is series connected to the discharge lamp 3.

As was described above, an ignition coil device is series-connected to the above described discharge lamp 3 in order to apply a high voltage pulse to the discharge lamp 3 when the lamp starts. However, the ignition coil device is not shown in FIG. 1.

The above described discharge lamp 3 is, for example, an ultra-high pressure discharge lamp of the short arc type which, as was described above, is used as the light source of a projector device of the projection type or the like. For example, the discharge lamp described below can be used:

Inside volume of the arc tube: 100 $mm^3$

Distance between the electrodes: 1.0 mm

Mercury: Amount added: 0.25 $mg/mm^3$

Rare gas: 100 torr argon added

The operating conditions of the above described discharge lamp are described below.

Lamp wattage in the range from 80 W to 400 W, for example, 200 W

Lamp current in the range from 0.6 A to 7.0 A, for example, 2.8 A

Lamp voltage in the range from 60 V to 130 V, for example, 70 V

The voltage reduction chopper circuit 1 is comprised of a switching device Q1, a diode D1, an inductance L1 and a smoothing capacitor C1. A control circuit (not shown) controls the ON/OFF ratio of the switching device Q1 and controls the current or wattage which is supplied to the discharge lamp 3 via the full bridge circuit 2.

The full bridge circuit 2 is comprised of switching devices Q2 to Q5 which are connected in a bridge-like manner and which are formed of transistors, like FETs or the like, and of diodes D2, D5 which are connected antiparallel to these switching devices Q2 to Q5.

The switching devices Q2 to Q5 are driven by a driver circuit (not shown), the discharge lamp is supplied with an alternating current with rectangular waves, and the discharge lamp 3 is operated.

This means that the switching devices Q2, Q5 and switching devices Q3, Q4 are turned on in alternation, alternating current with rectangular waves is supplied to the discharge lamp 3 in the line path: voltage reduction chopper circuit 1→switching device Q2→discharge lamp 3→inductance L1→switching device Q5→voltage reduction chopper circuit 1, and in the line path: voltage reduction chopper circuit 1→switching device Q4→inductance L1→discharge lamp 3→switching device Q3→voltage reduction chopper circuit 1, and drives the discharge lamp 3.

When driving the above described switching devices Q2 to Q5, a time (dead time) for turning off all switching devices Q2 to Q5 is assumed, as was described above, when switching the polarity of the alternating rectangular waves, in order to prevent the switching devices Q2 to Q5 from being turned on at the same time.

The frequency of the output alternating rectangular waves which are supplied to the discharge lamp 3 is in the range from 60 Hz to 1000 Hz, for example, 200 Hz. The above described dead time is normally in the range from 0.5 $\mu$s to 10 $\mu$s. In the case of a frequency of the output rectangular waves of 200 Hz, a dead time of, for example, about 1 $\mu$s is selected.

In this embodiment, in order to prevent extinction of the discharge lamp 3 during the above described dead time, on output side of the full bridge circuit 2, there is an inductance (inductance element) which is series-connected to the discharge lamp 3. By the energy stored in this inductance L2 during the dead time when switching the polarity of the rectangular waves via a loop which is formed by the inductance L2, diodes D2 to D5 and the smoothing capacitor C1 of the voltage reducing chopper circuit 1, a current is allowed to flow in the discharge lamp 3 and thus extinction of the discharge lamp 3 is prevented.

That is, during the above described dead time, by the energy stored in the inductance L2 with the loop inductance L2→discharge lamp 3→diode D2→smoothing capacitor C1→diode D5→inductance L2 or with the loop inductance L2→diode D4→smoothing capacitor C1→diode D3→discharge lamp 3→inductance L2 current can be allowed to flow. In this way, during the interval without current with rectangular waves, current can be allowed to flow from the full bridge in the discharge lamp 3.

Figure 2:
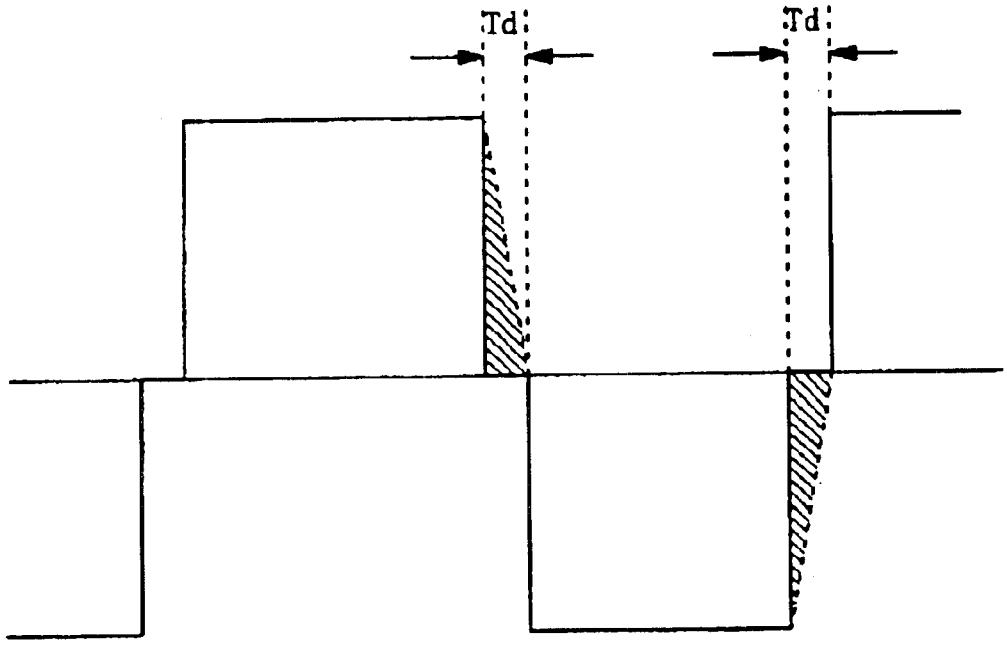
FIG. 2 is a plot of the current which flows during the dead time in a discharge lamp.

FIG. 2 schematically shows the current which flows during the above described dead time in the discharge lamp. In FIG. 2, Td indicates the dead time in which the energy stored in the inductance L2, with the above described loop, current is allowed to flow, as is shown using the broken lines in FIG. 2. The amount of energy stored in the inductance L2 must be at least equal to the area of the regions which are shown cross-hatched in FIG. 2. The energy stored in the inductance L2 is determined by the relationship:

$$\frac{1}{2} \times LL \times IL^2$$

Td is the above described dead time (seconds), and LL is the size of the inductance L2 (H). The lamp wattage W is determined by the relationship $$W = VL \times IL$$

where VL (V) is the magnitude of the above described voltage with rectangular waves (the voltage which is applied to the discharge lamp is called the luminous voltage), and IL (A) is the current flowing in the discharge lamp 3. The energy of the above described cross-hatched regions is $\frac{1}{2}\times W\times Td$.

Therefore, it is necessary for $\frac{1}{2}\times L\times I^2 \geqq \frac{1}{2}\times W\times Td$ so that, during the above described dead time, current flows uninterrupted in the discharge lamp 3. The above described formula can be rewritten $\frac{1}{2}\times LL\times IL^2 \geqq \frac{1}{2}\times VL\times Td$ so that it is therefore necessary to select the value LL of the inductance L2 in accordance with the relationship:

$$LL \geqq VL/IL\times Td$$

By connection of the inductance L2 which meets the above described condition to the discharge lamp 3 in series, current can be supplied to the discharge lamp 3 during the dead time Td and lamp extinction can be prevented In the case of the above described operating conditions, the value of the inductance L2 is in the range from 20 $\mu$H to 600 pH, for example, roughly 300 pH.

As was described above, in the case of connecting the ignition coil device to the discharge lamp 3 in series, the value of the inductance L2 can be chosen such that the sum of the value of the inductive reactance of the inductance L2 and the value of the inductive reactance of the ignition coil device has the above described value.

The energy stored in the inductance L2 flows via the smoothing capacitor C1 with the above described loop and is charged in the smoothing capacitor C1. It is therefore desirable for the value of the smoothing capacitor C1 to be fixed at greater than or equal to 0.1 $\mu$F, preferably in the range from 0.2 $\mu$F to 1 $\mu$F, in order to suppress the voltage increase of the smoothing capacitor C1.

In this embodiment, as was described above, the inductance L2 and the discharge lamp 3 are series-connected, and the value of the inductance L2 is chosen such that $LL \geqq VL/IL\times Td$. In this way, during the dead time, by the energy stored in the inductance L2 current can be allowed to flow in the discharge lamp 3 and extinction of the discharge lamp 3 can be prevented.

The value of the inductance L2 is also roughly 20 $\mu$H to 600 pH, as was described above. Since it is not necessary, as in the above described known example (Japanese patent specification HEI 6-101388, U.S. Pat. No. 4,734,624) to use an inductance L and a capacitor C with a high capacitance the rising and falling of the alternating rectangular waves which are output by the full bridge circuit can be made steep. The above described disadvantage of momentary darkening of the discharge lamp never occurs.

Figure 3:
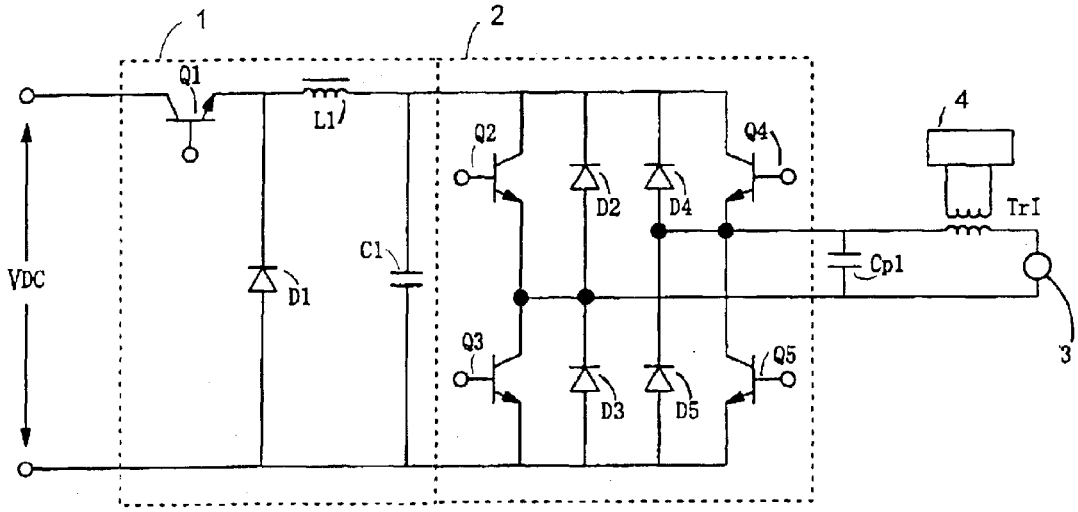
FIG. 3 is a schematic of the second embodiment of the arrangement of a device in accordance with the invention for operating a high pressure discharge lamp.

FIG. 3 shows a second embodiment of the invention. In this embodiment, the inductance of the ignition coil transformer of the ignition coil device which is series-connected to the discharge lamp 3 is used as an inductance which stores the energy which is used for current to flow during the dead time in the discharge lamp 3.

In FIG. 3, the same parts as in FIG. 1 are defined with the same reference numbers as in FIG. 1. In this embodiment, instead of the above described inductance L2, an ignition coil transformer TrI of the ignition coil device 4 is series-connected to the discharge lamp 3. Furthermore, a bypass capacitor Cp1 for bridging the high voltage pulse produced by the ignition coil device 4 is connected parallel to the discharge lamp 3 and to the series connection of the ignition coil transformer TrI.

The value of the inductance of the ignition coil transformer TrI, as was described above, is chosen to be a value which meets condition $LL \geqq VL/IL\times Td$.

The operation of the circuit in this embodiment is identical to that in the first embodiment. Here, the switching devices Q2 to Q5 of the full bridge circuit 2 are driven by a driver circuit (not shown), the discharge lamp 3 is supplied with an alternating current with rectangular waves and the discharge lamp 3 is operated.

During the dead time, current can be allowed to flow by the energy stored in the ignition coil transformer TrI with the loop ignition coil transformer TrI→discharge lamp 3→diode D2→smoothing capacitor C1→diode D5→ignition coil transformer TrI or with the loop ignition coil transformer TrI→diode D4→smoothing capacitor C1→diode D3→discharge lamp 3→ignition coil transformer TrI. In this way, current can be allowed to flow in the discharge lamp 3.

In this embodiment, as was described above, during the dead time by the energy stored in the ignition coil transformer 4*a* current can also be allowed to flow in the discharge lamp 3 without interruption and thus extinction of the discharge lamp 3 can be prevented.

The value of the inductance of the ignition coil transformer TrI is 20 $\mu$H to 600 pH, as was described in the first embodiment. Therefore, the rise and fall of the alternating rectangular waves which are output to the full bridge circuit can be made steep. The above described disadvantage of instantaneous darkening of the discharge lamp never occurs.

Since it is sufficient for the above described bypass capacitor Cp1 to work in such a way that it bridges the high voltage pulse produced by the ignition coil device 4, its capacitance value can be at most equal to 4000 pF, preferably roughly 1000 pF to 2000 pF.

In the above described known example (Japanese patent specification HEI 6101388, U.S. Pat. No. 4,734,624) a capacitor is connected parallel to a series connection of a discharge lamp and an inductance. However, this capacitor is used, as was described above, to produce a series resonance by the inductance and the capacitor and to allow an oscillating current to flow in the lamp. It is necessary to use a capacitor, for example, of roughly 0.1 $\mu$F for the above described capacitor. The capacitance of the above described bypass capacitor Cp1 which is used in this embodiment can, on the other hand, be less than or equal to 4000 pF. Even if there is a bypass capacitor Cp1, the effect on the rising and falling of the AC voltage with rectangular waves is low. The disadvantage of instantaneous darkening of the discharge lamp 3 never occurs.

Figure 4:
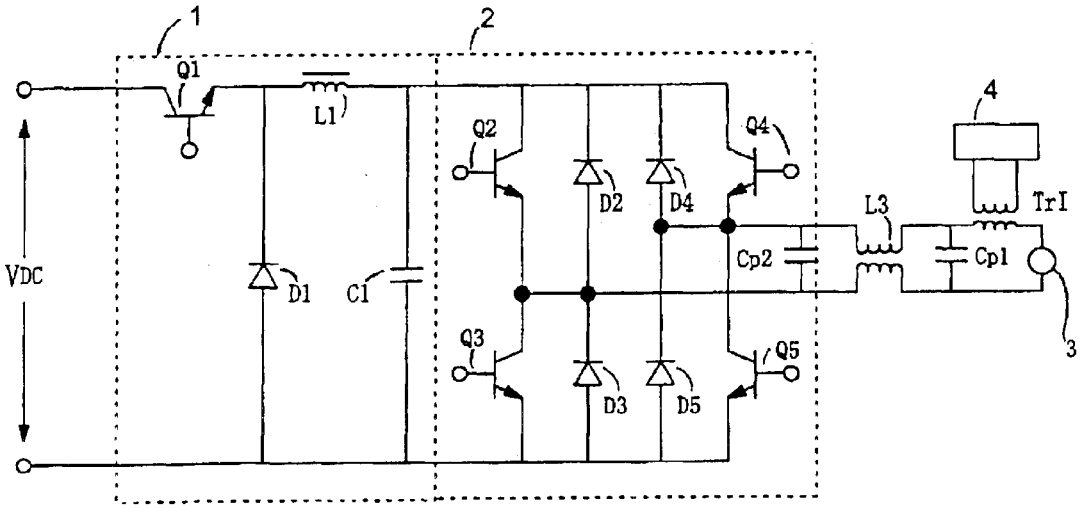
FIG. 4 is a schematic of the third embodiment of the arrangement of a device in accordance with the invention for operating a high pressure discharge lamp.
Figure 5:
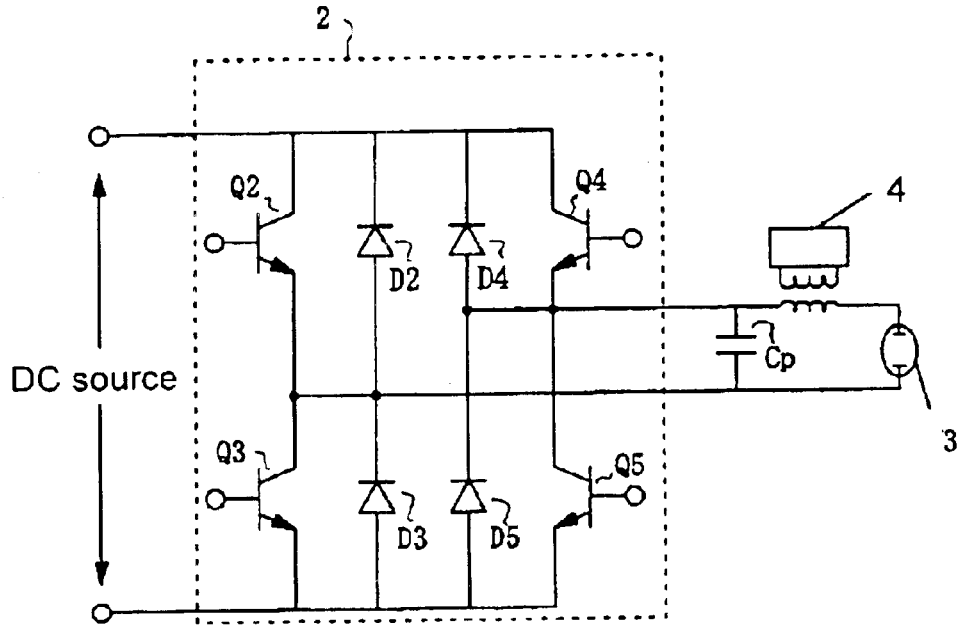
Fig. 5 (Prior Art)
FIG. 5 shows a schematic of one example of the arrangement of a known device for operating a discharge lamp.

FIG. 4 shows a third embodiment of the invention. In this embodiment, on the output side of the full bridge circuit 2, there is a reactance with common mode L3. In this way, damage to the electronic parts, like the full bridge circuit and the like, by the high voltage pulse of the ignition coil device is prevented.

FIG. 4 shows the same parts as in FIG. 3 with the same reference numbers as in FIG. 3. In this embodiment, as in the second embodiment, the inductance of the ignition coil transformer 4*a* of the ignition coil device is used as an inductance which stores the energy which is used for current to flow during the dead time in the discharge lamp 3.

The inductive reactance value of the ignition coil transformer 4*a*, as was described above, is chosen to be a value which meets condition $LL \geqq VL/IL\times Td$.

The reactance with common mode L3 which blocks passage of the high voltage pulse of the ignition coil device, and the bypass capacitors Cp1 and Cp2 for bridging this high voltage pulse are connected to the output side of the full bridge circuit 2.

The operation of the circuit in this embodiment is identical to that in the second embodiment. The switching devices Q2 to Q5 of the full bridge circuit 2 are driven by a driver circuit which is not shown in the drawings, the discharge lamp 3 is supplied with an alternating current with rectangular waves, and thus the discharge lamp 3 is operated.

During the dead time, current can be allowed to flow in the discharge lamp 3 by the energy stored in the ignition coil transformer TrI with the loop ignition coil transformer TrI→discharge lamp 3→reactance with common mode L3→diode D2->smoothing capacitor Cl→diode D5→reactance with common mode L3→ignition coil transformer TrI or with the loop ignition coil transformer TrI→reactance with common mode L3→diode D4→smoothing capacitor C1→diode D3→reactance with common mode L3→discharge lamp 3→ignition coil transformer TrI.

Since, in the reactance with common mode L3, a current with the reverse direction flows, the fluxes which are formed by the currents cancel out one another. No effect is exercised on the current flowing in the above described loop.

In this embodiment, as in the first and second embodiment, during the dead time, by the energy stored in the ignition coil transformer 4*a*, current can flow uninterrupted in the discharge lamp 3, and thus, extinction of the discharge lamp 3 can be prevented. Therefore, the rising and falling of the alternating rectangular waves which are output to the full bridge circuit can be made steep. The above described disadvantage of instantaneous darkening of the discharge lamp never occurs.

Furthermore, since it is sufficient if the bypass capacitors Cp1 and Cp2 have a relatively small capacitance, as in the third embodiment, the effect on the rising and falling of the rectangular AC voltage is low. The disadvantage of instantaneous darkening of the discharge lamp never occurs.

Action of the Invention

As was described above, in accordance with the invention, on the output side of the full bridge circuit, there is an inductance and the value of this inductance is fixed in such a way that $LL \geqq VL/IL \cdot Td$ (where VL is the luminous voltage of the discharge lamp, IL is the current flowing in the discharge lamp, and Td is the dead time). Therefore, lamp extinction which occurs due to the dead time of the alternating rectangular waves can be prevented, and moreover, the rising and falling of the alternating rectangular waves can be made steep. Thus, the disadvantage of instantaneous darkening of the discharge lamp can be eliminated.

Therefore, by using the device in accordance with the invention for operating a high pressure discharge lamp which is used as the light source of a projector of the projection type, it is possible to improve the image quality of the projector.

What is claimed is:

1. High pressure discharge lamp device comprising:

a high pressure discharge lamp having a pair of opposed electrodes in a silica glass discharge vessel, a DC power source, an inverter circuit having a front stage and a rear stage and which is comprised of four switching devices connected in a bridge circuit manner, by which a dead time is produced when all switching devices are turned off, and which converts a DC current from said power source into an AC current supplied to the high pressure discharge lamp, a capacitor which is connected in the front stage of the inverter circuit, and an inductance element which is series-connected in the rear stage of the inverter circuit and to the high pressure discharge lamp, and said inductance element, together with the capacitor, forming a loop which, during said dead time, supplies current to the high pressure discharge lamp, and wherein a value LL (H) of the inductance L of the above described inductance element is fixed in accordance with the relationship $LL \geqq VL/IL \cdot Td$, where VL is the luminous voltage of the discharge lamp, IL (A) is the current flowing in the discharge lamp and Td (seconds) is the dead time.

2. Device for operating a high pressure discharge lamp in accordance with claim 1, wherein at least part of the above described inductance element is formed from an ignition coil transformer.

* * * * *